US008818011B2

(12) United States Patent
Chen

(10) Patent No.: US 8,818,011 B2
(45) Date of Patent: Aug. 26, 2014

(54) NOISE-REDUCING HEADSET

(71) Applicant: High Rainbow Ent, Co., Ltd, Tainan (TW)

(72) Inventor: Chun-Chieh Chen, Tainan (TW)

(73) Assignee: High Rainbow Ent, Co., Ltd, Tainan (TW)

( * ) Notice: Subject to any disclaimer, the term of this patent is extended or adjusted under 35 U.S.C. 154(b) by 0 days.

(21) Appl. No.: 13/765,341

(22) Filed: Feb. 12, 2013

(65) Prior Publication Data

US 2014/0112519 A1 Apr. 24, 2014

(30) Foreign Application Priority Data

Oct. 23, 2012 (TW) ..... 101139180 A

(51) Int. Cl.
*H04R 25/00* (2006.01)

(52) U.S. Cl.
USPC ..... 381/379; 381/370; 381/374

(58) Field of Classification Search
USPC ..... 381/370, 374, 378–381, 383
See application file for complete search history.

(56) References Cited

U.S. PATENT DOCUMENTS

| | | | | |
|---|---|---|---|---|
| 4,409,442 | A * | 10/1983 | Kamimura | 381/383 |
| 6,654,966 | B2 * | 12/2003 | Rolla | 381/383 |
| 6,678,897 | B2 * | 1/2004 | Lindgren | 381/383 |
| 6,993,143 | B2 * | 1/2006 | Harris et al. | 381/383 |
| 8,213,667 | B2 * | 7/2012 | Nelson et al. | 381/378 |

* cited by examiner

*Primary Examiner* — Suhan Ni
(74) *Attorney, Agent, or Firm* — Muncy, Geissler, Olds & Lowe, P.C.

(57) ABSTRACT

A noise-reducing headset, comprising a suspending arm, a connection device, and an ear cover part is disclosed. An engaging device is disposed on both ends of the suspending arm, wherein a position fixing part is disposed on one end of each of the engaging devices. Both ends of each of the connection device are respectively provided with a pivot joint part and an opening for engaging the engaging device. One side of the connection device is provided with a hollow slot. The hollow slot is communicated with the opening such that the position fixing part adjusts the distance the suspending arm entering into the connection device. Moreover, the ear cover part is connected to the pivot joint part of the connection device such that the noise-reducing headset can be collapsed inward by using the pivot joint part to make the noise-reducing headset convenient for a user to take along.

5 Claims, 5 Drawing Sheets

NOISE-REDUCING HEADSET

CROSS-REFERENCE TO RELATED APPLICATION

This application claims priority from Taiwan Patent Application No. 101139180, filed on Oct. 23, 2012, the contents of which are hereby incorporated by reference in their entirety for all purposes.

BACKGROUND OF THE INVENTION

1. Field of the Invention

The present invention relates to a noise-reducing headset, and particularly, to a noise-reducing headset which allows a user to adjust the length of the suspending arm entering the connecting part.

2. Description of the Related Art

In recent years the design trend of the electronic products (e.g., MP3s, smart phones, and tablet PCs) unanimously goes toward thinner and lighter such that it is easier and more convenient for users to carry and handle this kind of products. The peripheral products must keep improving to follow this trend. A headset is the best example. Headsets can be roughly classified as the headphone type, the ear plug type, and the ear hook type, etc.

Traditional headphone headsets are inconvenient to carry due to their big sizes. Thus, a plurality of manufacturers begin to improve the folding mechanism of the headset and the adjusting mechanism of the suspending arm of the headset ear cover. By adjusting the length of the suspending arm and collapsing inward the ear covers, the size of a headset can be greatly reduced and makes it convenient for users to take along.

SUMMARY OF THE INVENTION

Based on the problems of the prior arts, one of the objects of the present invention is to provide a noise-reducing headset with the capability of adjusting the distance the suspending arm entering into the connection device.

According to the object of the present invention, the present invention provides a noise-reducing headset comprising a suspending arm, at least a connection device, and at least an ear cover part. An engaging device is disposed on both ends of the suspending arm and a position fixing part is disposed on one end of each of the engaging devices. Both ends of each of the connection device are respectively provided with a pivot joint part and an opening for engaging the engaging device. One side of the connection device is provided with a hollow slot comprising a plurality of position fixing holes, and the hollow slot is communicated with the opening such that the position fixing part of the engaging device can be used to adjust the distance the suspending arm entering into the connection device by engaging into the plurality of position fixing holes of the hollow slot. Additionally, the present invention further comprises at least an ear cover part, the ear cover part is, for example, pivotally connected to the pivot joint part of the connection device.

The present invention optionally further comprises a position clamping part and a pivot arm. The position clamping part is located on one side of the engaging device. The hollow slot further comprises a position clamping hole to prevent the suspending arm from disengaging the connection device. The ear cover part is pivotally connected to the pivot joint part of the connection device by hooking up the pivot arm.

Preferably, the engaging device further comprises a depressed portion located on the other side of the engaging device and the position of the depressed portion corresponds to that of the position clamping part.

Preferably, the plurality of position fixing holes are arranged in intervals such that the hollow slot is odontoid.

Preferably, each of the two ends of the suspending arm further comprises two guide plates spaced at a gap on both sides of the engaging device.

As mentioned above, the main characteristic and advantage of the noise-reducing headset of the present invention is that a user can adjust the distance the suspending arm entering the connection device based on his or her personal need.

DETAILED DESCRIPTION OF THE PREFERRED EMBODIMENTS

With reference to the drawings, thereafter, the preferred embodiment of the noise-reducing headset in accordance with the present invention is illustrated. In order to be understood easily, the same components in the preferred embodiment are labeled as the same numeral.

Figure 1:
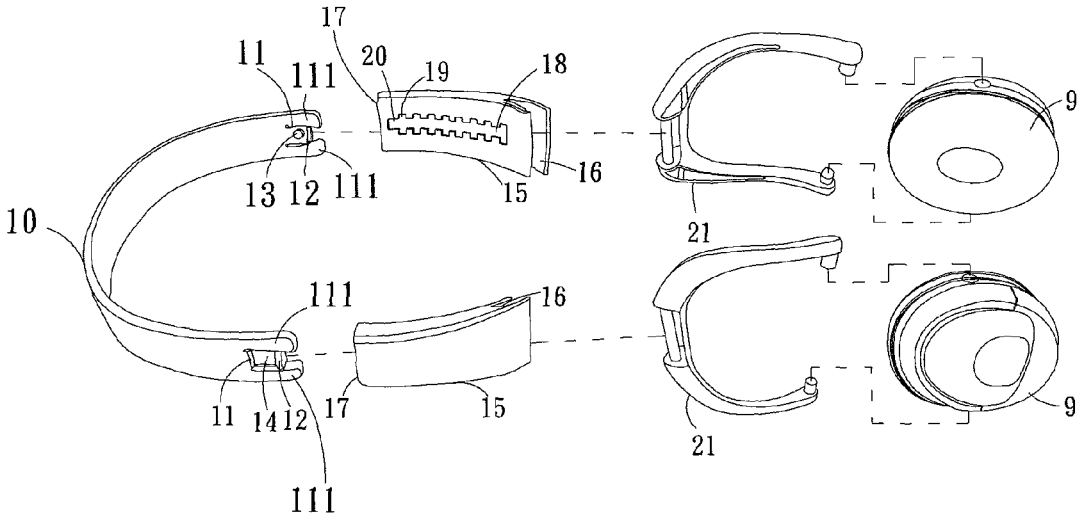
FIG. 1 is an exploded view showing the noise-reducing headset according to the preferred embodiment of the present invention.
Figure 2A:
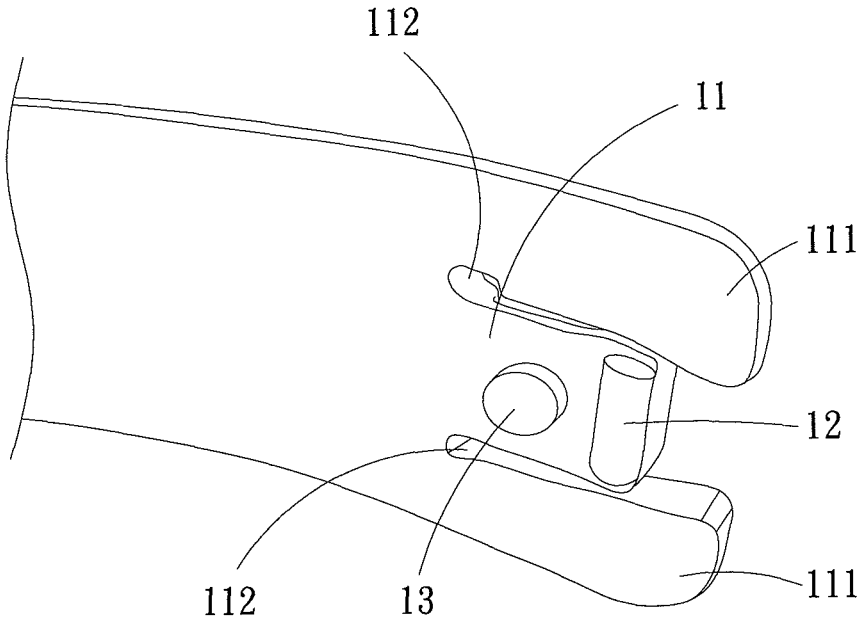
FIG. 2A is a schematic structure diagram showing one side of the engaging device of the noise-reducing headset according to the preferred embodiment of the present invention.
Figure 3:
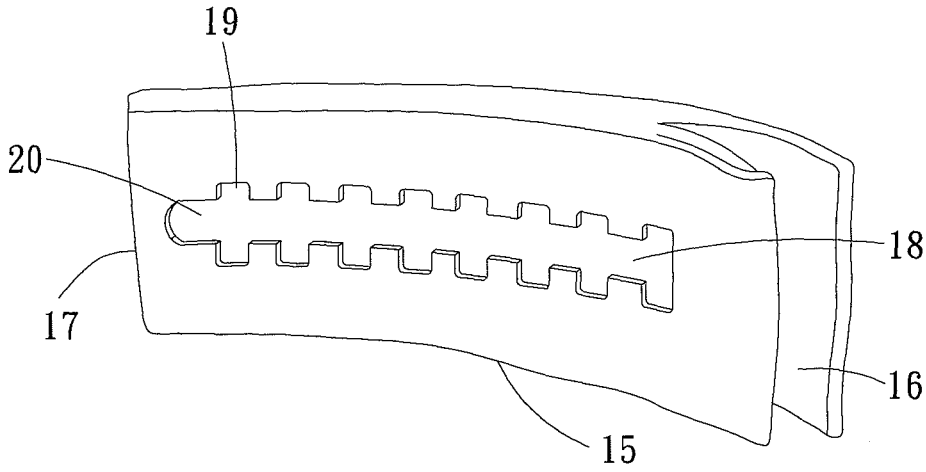
FIG. 3 is a schematic structure diagram showing the connection device of the noise-reducing headset according to the preferred embodiment of the present invention.
Figure 4:
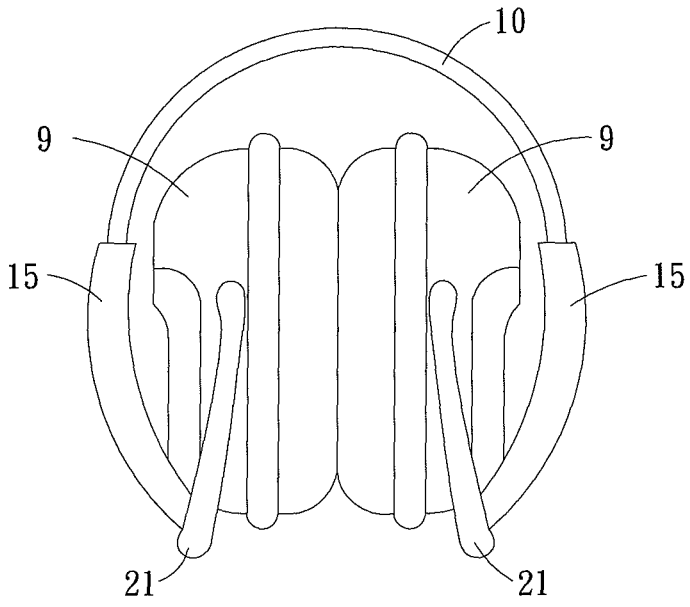
FIG. 4 is the sectional view diagram showing the noise-reducing headset according to the preferred embodiment of the present invention.

Referring to FIGS. 1 and 4, FIGS. 1 and 4 are the exploded view and the sectional view diagram showing the noise-reducing headset according to the preferred embodiment of the present invention, respectively. The present invention of the noise-reducing headset at least comprises a suspending arm 10, at least a connection device 15, and at least an ear cover part 9. An engaging device 11 is disposed on both ends of the suspending arm 10, and a position fixing part 12 is installed on one end of each of the engaging devices 11. The shape of the position fixing part 12 is, for example, an elongated (as shown in FIG. 2A) or other shapes, the present invention is not limited to these. As long as the position fixing part 12 can be engaged into a plurality of position fixing holes 19 of the hollow slot 18 of the connection device 15, it is suitable for the present invention. Similarly, as long as the length of the position fixing part 12 is appropriate for the position fixing part 12 to be engaged into a plurality of position fixing holes 19 of the hollow slot 18 of the connection device 15, it is suitable for the present invention. Additionally, as shown in FIG. 3, both ends of each of the connection device 15 are respectively provided with a pivot joint part 16 and an opening 17 for engaging the engaging device 11. One side of the connection device 15 is provided with a hollow slot 18 comprising a plurality of position fixing holes 19. The hollow slot 18 is connected to the opening 17. The aforementioned pivot joint part 16 is, for example, U-shaped, yet not limited to this.

As long as the pivot joint part 16 can be pivotally connected to the pivot arm 21, it is suitable for the present invention. The position fixing part 12 of the engaging device 11 can be used to section by section adjust a distance the suspending arm 10 entering into the connection device 15 by engaging into the plurality of position fixing holes 19 of the hollow slot 18. The plurality of position fixing holes 19 can be arranged in intervals or in non-intervals such that the hollow slot 18 is odontoid. The position fixing hole 19 can be any shape as long as it can be section by section engaged into the position fixing part 12 of the engaging device 11, for example U shaped (as shown in FIG. 3), V shaped, curved shaped, or other shapes.

Figure 2B:
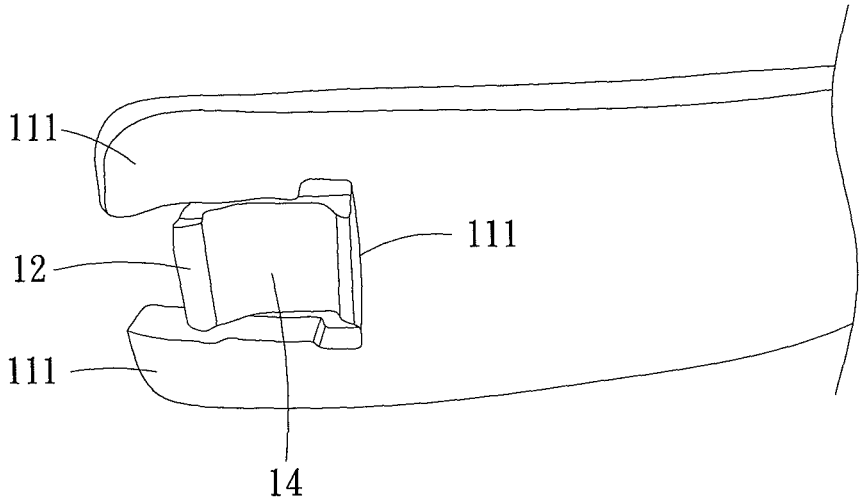
FIG. 2B is a schematic structure diagram showing the other side of the engaging device of the noise-reducing headset according to the preferred embodiment of the present invention.

Additionally, the suspending arm 10 of the present invention can selectively include a position clamping part 13 based on practical needs. The position clamping part 13 is mounted on one side of the engaging device 11. The hollow slot 18 of the connection device 15 can be selectively provided with a position clamping hole 20 to clamp the position clamping part 13 of the suspending arm 10 to further prevent the suspending arm 10 from disengaging the connection device 15 (as shown in FIGS. 2A and 3). The aforementioned position clamping part 13 can be of any shape, for example, U shaped, V shaped, or curved shaped. Additionally, a depression portion 14 can be disposed on the other side of the engaging device 11. The position of the depression portion 14 is preferably corresponding to that of the position clamping part 13 (as shown in FIG. 2B). Moreover, each of the two ends of the suspending arm 10 can be selectively provided with two guide plates 111 disposed on both sides of the engaging device 11 with a preset gap 112 (as shown in FIG. 2A). The two gaps 112 are located between the aforementioned guide plates 111 and the engaging device 11. When the suspending arm 10 is entering the connection device 15, the two gaps 112 can increase the elasticity of the suspending arm 10, such that the suspending arm 10 can easily enter the connection device 15 with the aid of the two guide plates 111 and proceed to the length adjustment.

As mentioned above, the ear cover part 9 of the present invention is connected to the pivot joint part 16 of the connection device 15, the connection method can be a pivot connection or any other manners which allow the ear cover part 9 to rotate. In other words, the ear cover part 9 and the pivot joint part 16 can also be a fixed connection based on practical needs. This kind of connection belongs to the prior arts and will not be illustrated. Additionally, the present invention can further comprise a pivot arm 21. The ear cover part 9 is pivotally connected to the pivot joint part 16 of the connection device 15 by hooking up the pivot arm 21 (as shown in FIGS. 1 and 4). The connection method between the ear cover part 9 and the pivot arm 21 can be, for example, pivot connecting, engaging, or locking, as long as the connection allows the ear cover part 9 to be fastened on the pivot arm 21 and does not restrict the way of rotation between the pivot arm 21 and the pivot joint part 16. The structure of the ear cover part 9 can be, for example, that of a normal ear set or ear plug.

Please refer to FIG. 4 and further refer to FIG. 1. When a user is going to use the noise-reducing headset of the present invention, he or she can adjust the length of the suspending arm 10 to meet his or her own need. The adjustment method is via the engaging of the position fixing part 12 of the engaging device 11 into the position fixing hole 19 of the hollow slot 18 to adjust the distance the suspending arm 10 entering the connection device 15. The shorter the distance the suspending arm 10 entering the connection device 15, the longer the distance between the ear cover part 9 and the suspending arm 10. On the contrary, the longer the distance the suspending arm 10 entering the connection device 15, the shorter the distance between the ear cover part 9 and the suspending arm 10. In this manner the user can adjust the length of the noise-reducing headset by his or her own need and wears this noise-reducing headset with comfort.

In summary, the smart designs of the noise-reducing headset of the present invention enables the user to adjust the distance the suspending arm entering the connection device via the suspending arm and the connection device. Allowing the user to make personal adjustments, the present invention provides the user with the most suitable noise-reducing headset of his or her own.

The present invention has been described with reference to the foregoing preferred embodiment, it will be understood that the present invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A noise-reducing headset, comprising:

a suspending arm, wherein an engaging device is disposed on both ends of the suspending arm and a position fixing part is disposed on one end of each of the engaging devices;

at least a connection device, wherein both ends of each of the connection device are respectively provided with a pivot joint part and an opening for engaging the engaging device; one side of the connection device is provided with a hollow slot comprising a plurality of position fixing holes; and the hollow slot is communicated with the opening such that the position fixing part of the engaging device adjusts a distance the suspending arm entering into the connection device by engaging into the plurality of position fixing holes of the hollow slot; and at least an ear cover part, wherein the ear cover part is connected to the pivot joint part of the connection device, wherein the suspending arm further comprises a position clamping part located on one side of the engaging device and the hollow slot further comprises a position clamping hole to prevent the suspending arm from disengaging the connection device, and wherein the engaging device further comprises a depressed portion located on the other side of the engaging device and the position of the depressed portion corresponds to that of the position clamping part.

2. The noise-reducing headset of claim 1, wherein the plurality of position fixing holes are arranged in intervals such that the hollow slot is odontoid.

3. The noise-reducing headset of claim 1, wherein the ear cover part is pivotally connected to the pivot joint part of the connection device.

4. The noise-reducing headset of claim 1, further comprising at least a pivot arm and the ear cover part pivotally connected to the pivot joint part of the connection device by hooking up the pivot arm.

5. The noise-reducing headset of claim 1, wherein each of the two ends of the suspending arm further comprises two guide plates spaced at a gap on both sides of the engaging device.

* * * * *